United States Patent [19]

Morita et al.

[11] 4,423,705

[45] Jan. 3, 1984

[54] COOLING SYSTEM FOR LIQUID-COOLED INTERNAL COMBUSTION ENGINES

[75] Inventors: Yasuyuki Morita; Katsuhiko Yokooku; Hideo Shiraishi; Masahiko Matsuura, all of Hiroshima, Japan

[73] Assignee: Toyo Kogyo Co., Ltd., Hiroshima, Japan

[21] Appl. No.: 361,823

[22] Filed: Mar. 25, 1982

[30] Foreign Application Priority Data

Mar. 26, 1981 [JP] Japan ..... 56-44985
Mar. 27, 1981 [JP] Japan ..... 56-45739

[51] Int. Cl.[3] ..... F01P 5/12

[52] U.S. Cl. ..... 123/41.02; 123/41.29; 123/41.44; 123/41.72

[58] Field of Search ..... 123/41.29, 41.72, 41.82 R, 123/41.82 A, 41.44, 41.02

[56] References Cited

U.S. PATENT DOCUMENTS 1,829,195 10/1931 Simmen ..... 123/41.44
4,319,547 3/1982 Bierling ..... 123/41.29

FOREIGN PATENT DOCUMENTS 53-136144 11/1978 Japan .
55-35167 3/1980 Japan .
56-148610 11/1981 Japan ..... 123/41.01

*Primary Examiner*—William A. Cuchlinski, Jr.
*Attorney, Agent, or Firm*—Fleit, Jacobson, Cohn & Price

[57] ABSTRACT

Engine cooling system including cooling water passages having cooling water jackets formed respectively in the hot temperature portion and the cold temperature portion of the engine and water pumps for circulating cooling water through the water passages. Driving motors are provided for driving the water pumps and a control circuit for the motors receives an engine speed signal so that the water pump for the water passage to the cold temperature portion of the engine is stopped when the engine temperature is low so that the engine can be warmed up rapidly while maintaining a cooling water circulation through the water passage in the hot temperature portion for preventing local overheating of the engine.

8 Claims, 10 Drawing Figures

COOLING SYSTEM FOR LIQUID-COOLED INTERNAL COMBUSTION ENGINES

The present invention relates to a cooling system for a liquid-cooled internal combustion engine, and more particularly to a control system for cooling medium feed pump means.

Conventional liquid-cooled engines have cooling liquid jackets formed in the cylinder blocks and the cylnder heads, and pumps are provided for circulating the cooling medium through the jackets. Such cooling medium feed pumps are conventionally connected through belt-pulley mechanisms with the engine crankshafts so that the pumps are continuously driven by the engine crankshafts to thereby circulate the cooling medium through the jackets. The capacities of the pumps are determined so that a sufficient amount of cooling medium is circulated to provide a satisfactory cooling capacity even under a hot weather and a heavy duty operation. Therefore, there is a problem that, when the engine is operated in a very cold atmosphere and the engine speed is low, a substantially increased time is required for warming up the engine due to an excessive cooling. Further, since the cooling medium feeding pump is unnecessarily driven even under a cold operation, there will be a noticeable energy loss which leads to a poor fuel economy.

In Japanese patent application No. 52-49910 filed on May 2, 1977 and disclosed for public inspection on Nov. 28, 1978 under the public disclosure number of No. 53-136144, there is proposed to provide a clutch in the pump driving belt-pulley mechanism so that the clutch is disengaged when the engine cooling medium temperature is below a predetermined value. According to this proposal, the engine can be relieved of driving effort under a cold engine temperature so that it can be warmed up quickly and any energy loss due to the unnecessary driving of the pump can successfully be eliminated.

Further, Japanese patent application No. 53-108611 filed on Sept. 6, 1978 and disclosed for public inspection under the disclosure number of No. 55-35167 proposes to provide clutches in the driving mechanism for the cooling medium circulating pump as well as in the driving mechanism for the radiator cooling fan so that the pump and the fan can be stopped under a cold engine operation. The proposed mechanisms are not however recommendable because the engine may be subjected to a thermal shock when the clutch or clutches are engaged to transmit driving torque to the pump and the fan and a substantial amount of cooling medium is started to circulate. Further, the engine may have a further problem of local overheat if the cooling medium pump is completely stopped and the cooling medium is circulated only under a natural convection. In fact, the cylinder head temperature rises very quickly particularly in the vicinity of the combustion chamber and those areas close to the exhaust ports may become overheat conditions even when the overall engine temperature is below a predetermined value.

It is therefore an object of the present invention to provide an engine cooling system in which unnecessary driving effort for the cooling medium pump can be eliminated under a low engine temperature condition and engine warming up can be accelerated without danger of local overheating.

Another object of the present invention is to provide a device for controlling the operation of the engine cooling medium pump, by which the pump can be operated independently from the engine.

According to the present invention, the above and other objects can be accomplished by a cooling system for a liquid-cooled internal combustion engine including a high temperature portion and a low temperature portion, said cooling system comprising first cooling liquid passage means having first cooling liquid jacket means provided in the high temperature portion of the engine for passing cooling liquid therethrough, second cooling liquid passage means having second cooling liquid jacket means provided in the low temperature portion of the engine for passing cooling liquid therethrough, cooling liquid pump means for circulating the cooling liquid through said first and second passage means and said first and second jacket means, driving means for driving said pump means, engine temperature sensing means for sensing engine temperature and producing an engine temperature signal, control means adapted to receive the engine temperature signal and control said driving means so that an overall amount of cooling liquid circulation is decreased and the cooling liquid is passed only through said high temperature portion of the engine, when the engine temperature is below a first predetermined value. For the purpose, the pump means may include a first and second pumps which are respectively provided in said first and second cooling liquid passage means and the second pump is completely stopped. At this time, the speed of the first pump may be decreased to decrease the flow of the cooling liquid through the first passage. The speed of the first pump may be abruptly decreased at the predetermined engine temperature but in a preferable embodiment the first pump speed is gradually changed. It is further preferable in the present invention to completely stop circulation of cooling liquid when the engine temperature is below a second predetermined value which is lower than the first predetermined value.

In an alternative aspect, the pump means may include a commom pump which is connected through flow divider valve means with said first and second cooling liquid passage means and the control means includes means to control said flow divider valve means as well as means to control the common pump. Alternatively, the first and second cooling liquid passage means may be connected in series through a bypass valve which makes it possible to bypass the second cooling liquid passage means when the engine temperature is below the first predetermined value.

The above and other objects and features of the present invention will become apparent from the following descriptions of preferred embodiments taking reference to the accompanying drawings, in which:

FIG. 1 is a diagrammatical view of an engine having a cooling system in accordance with one embodiment of the present invention;

FIGS. 2(A) and (B) are diagrams showing alternative ways of cooling liqulid flow control in the embodiment shown in FIG. 1;

FIGS. 3(A) and (B) are circuit diagrams for performing the cooling liquid flow control shown in FIGS. 2(A) and (B), respectively;

Figure 3:
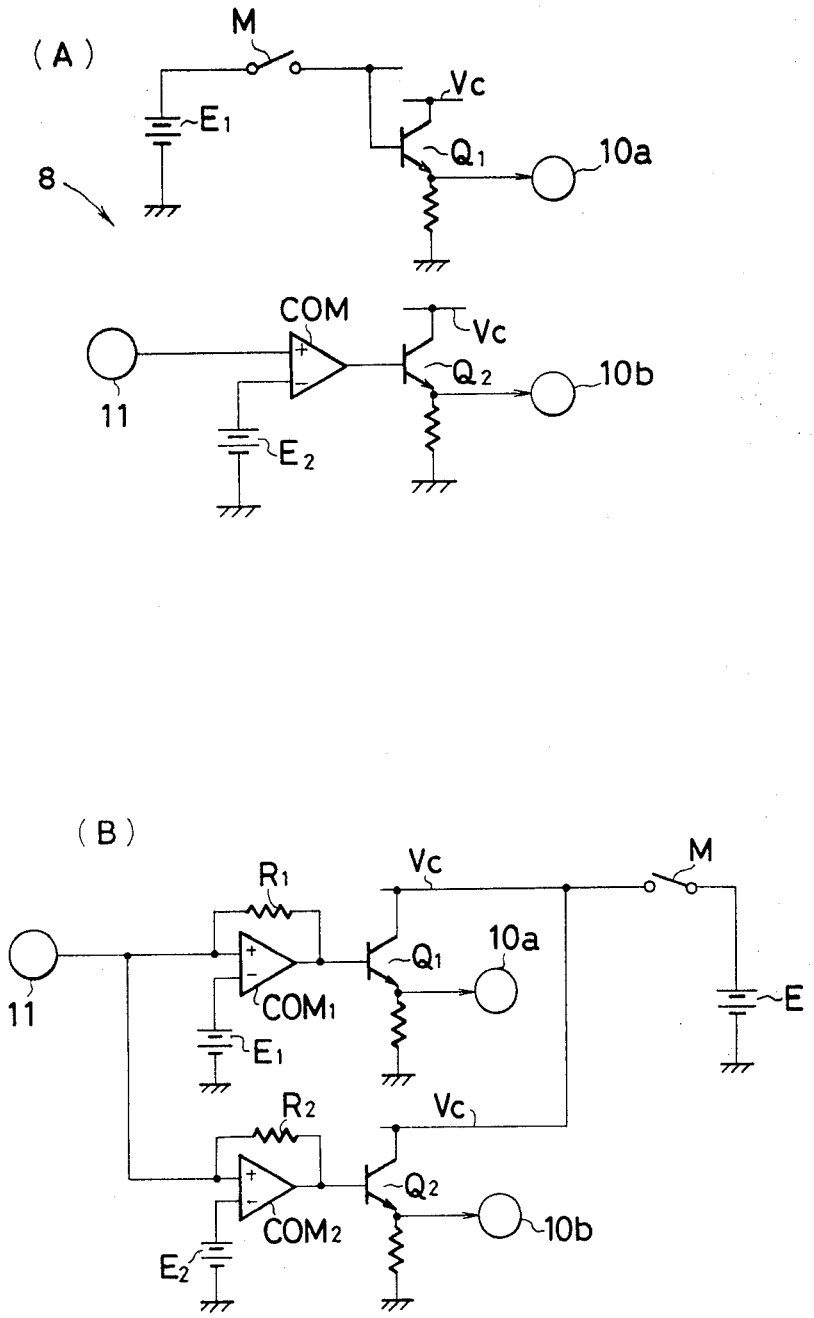
Figure 6:
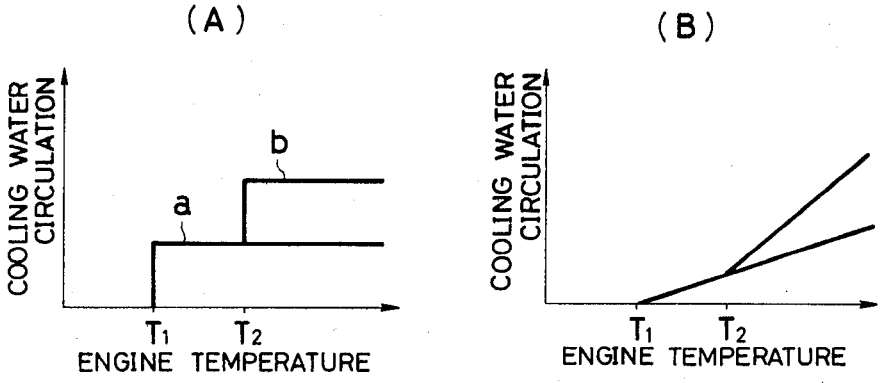
Figure 7:
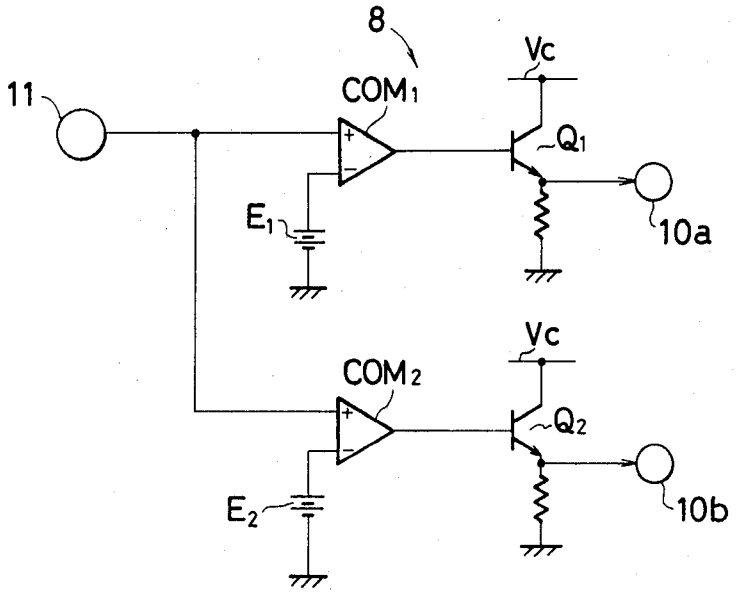

FIGS. 6(A) and (B) are diagrams similar to FIGS. 3(A) and (B) but another ways of control; and FIG. 7 is a circuit diagram for performing the control shown in FIG. 6(A).

Figure 1:
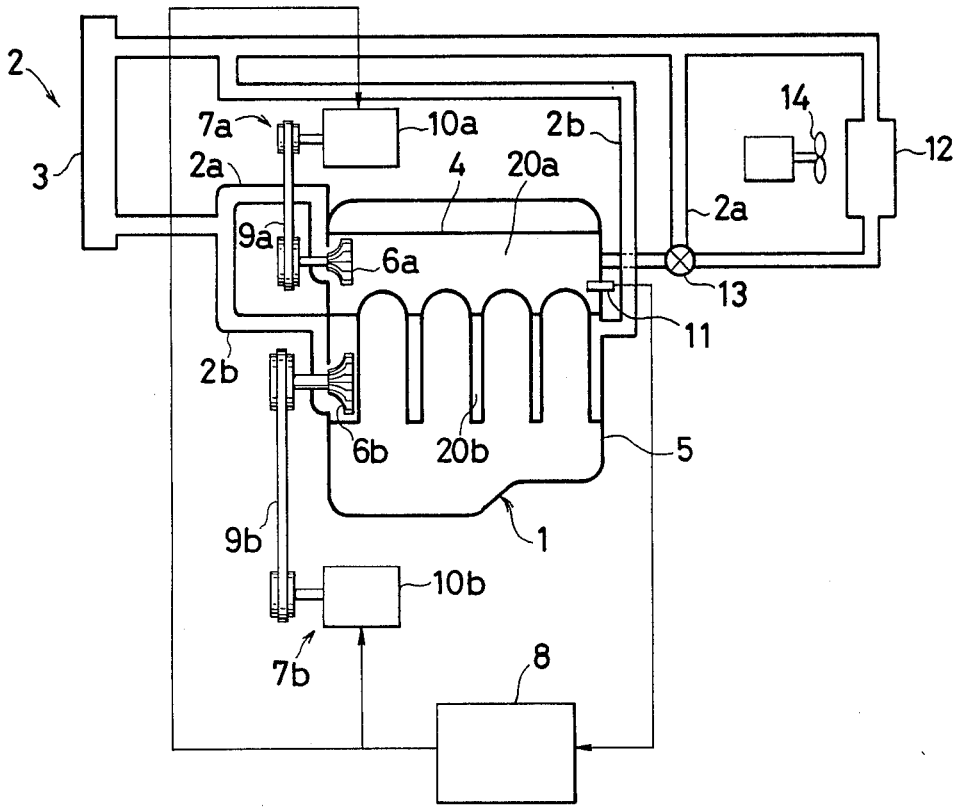

Referring now to the drawings, particularly to FIG. 1, there is shown an engine 1 having a cooling water passage 2 provided with a radiator 3. The engine 1 includes a cylinder head 4 and a cylinder block 5 which are formed with cooling water jackets 20*a* and 20*b*, respectively, forming parts of the cooling water passage 2 as well known in the art. The cooling water passage 2 is divided into branch passages 2*a* and 2*b* which lead respectively to the jackets 20*a* and 20*b*.

The engine 1 is further provided with water pumps 6*a* and 6*b* which are disposed in the cooling water passages 2*a* and 2*b*, respectively, for circulating the cooling water through the water jackets 20*a* and 20*b*. The pumps 6*a* and 7*a* are drivingly connected with variable speed motors 10*a* and 10*b*, respectively, through belt-pulley type driving mechanism 7*a* and 7*b* including driving belts 9*a* and 9*b*, respectively, so that the pumps 6*a* and 6*b* are driven by the motors 10*a* and 10*b*. A controller 8 is provided for controlling the operations of the motors 10*a* and 10*b*. The controller 8 is connected with the output of an engine temperature sensor 11 so that it controls the speeds of the motors 10*a* and 10*b* in accordance with the engine temperature. The temperature sensor 11 is located preferably at a high temperature portion such as the cylinder head 4 of the engine 1.

As shown in FIG. 1, the cooling water passage 2*a* is further provided with a heat exchanger 12 for a room heater. A blower fan 14 is provided for blowing air through the heat exchanger 12 to the room (not shown). In the water passage 2*a*, there is provided a control valve 13 for controlling the water flow to the heat exchanger 12.

Referring now to FIG. 3(A), it will be noted that the controller 8 includes switching transistors $Q_1$ and $Q_2$ which have emitters connected with the motors 10*a* and 10*b*, respectively. The collectors of the transistors $Q_1$ and $Q_2$ are connected with the line voltage Vc. The base of the transistor $Q_1$ is connected through a main switch M with the output of a power source $E_1$. The base of the transistor $Q_2$ is connected with the output of a comparator COM which has a positive input terminal connected with the output of the engine temperature sensor 11 and a negative input terminal connected with a reference voltage source $E_2$.

Figure 2:
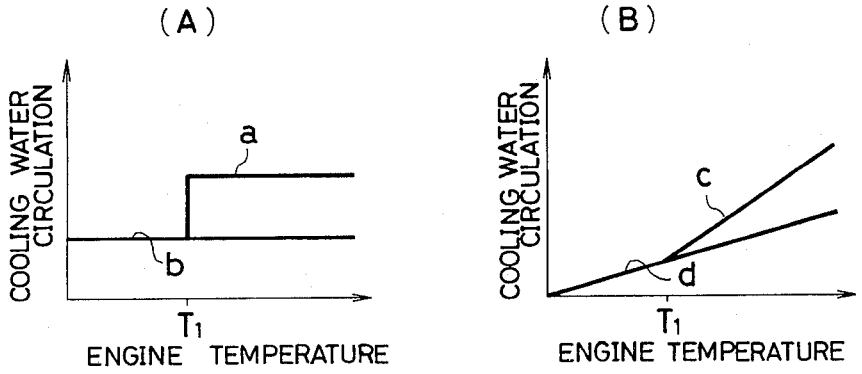

It will therefore be understood that when the main switch M is closed the transistor $Q_1$ is turned on and the line voltage $V_C$ is applied to the motor 10*a*. Further, when the engine is operated under a normal temperature such as a temperature higher than $T_1$ in FIG. 2, the output voltage of the engine temperature sensor 11 is higher than the reference voltage $E_2$ so that a high level signal is produced at the output of the comparator COM. Therefore, the transistor $Q_2$ is turned on and the line voltage $V_C$ is applied to the motor 10*b*. Both of the motors 10*a* and 10*b* and therefore the pumps 6*a* and 6*b* are operated to provide cooling liquid circulation through both the passages 2*a* and 2*b* as shown by a line a in FIG. 2(A). When the engine temperature is lower than the reference value $T_1$, the output voltage of the sensor 11 is lower than the reference voltage $E_2$ so that a low level signal is produced at the output of the comparator COM. Thus, the transistor $Q_2$ is turned off and the motor 10*b* is stopped. Therefore, the cooling water is circulated only through the passage 2*a* as shown by a line b in FIG. 2(A). Since the water circulation is maintained in the water jacket 20*a* formed in the cylinder head 4, it is possible to prevent local overheating.

Referring now to FIG. 3(B), it will be noted that the circuit shown therein is different from that shown in FIG. 3(A) in that a feedback resistor $R_2$ is provided between the output terminal and the positive input terminal of the comparator $COM_2$ and the base of the transistor $Q_1$ is connected with the output of a comparator $COM_1$. The comparator $COM_1$ has a positive input connected with the output of the temperature sensor 11 and a negative input connected with a reference voltage source $E_1$. A feedback resistor $R_1$ is connected between the output and the positive input of the comparator $COM_1$. Therefore, the speed of the motor 10*a* and the speed of the pump 6*a* are changed gradually so that the cooling water circulation through the jacket 20*a* is gradually increased as the engine temperature increases as shown by a line d in FIG. 2(B). Further, when the engine temperature is increased beyond the reference value $T_1$, a high level signal is produced at the output of the comparator $COM_2$ and the output increases gradually as the engine temperature increases. Therefore, the motor 10*b* and the pump 6*b* are started to operate and their speeds increase as the engine temperature increases. As the result, the cooling water circulation through the jacket 20*b* is gradually increased in response to an increase in the engine temperature as shown by a line c in FIG. 2(B).

Figure 4:
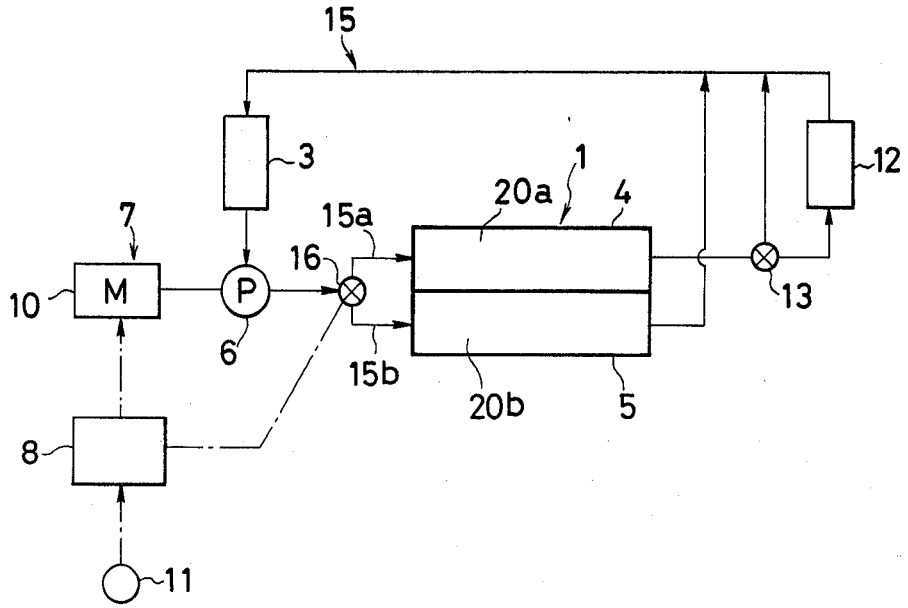
FIG. 4 is a diagrammatical view of the engine cooling system in accordance with another embodiment of the present invention.

Referring now to FIG. 4, it will be noted that the jackets 20*a* and 20*b* in the cylinder head 4 and the cylinder block 5, respectively, are connected in parallel with each other to a cooling liquid passage 15 through branch passages 15*a* and 15*b*, respectively. In this embodiment, however, a single cooling water pump 6 is located in the cooling water passage 15 and a flow divider valve 16 is provided at the junction between the branch passages 15*a* and 15*b*. A motor 10 is connected with the pump 6 to drive the same. The controller 8 controls not only the motor 10 for driving the pump 6 but also the valve 16 for obtaining the flow of the cooling water as shown in FIG. 2(A) or 2(B).

Figure 5:
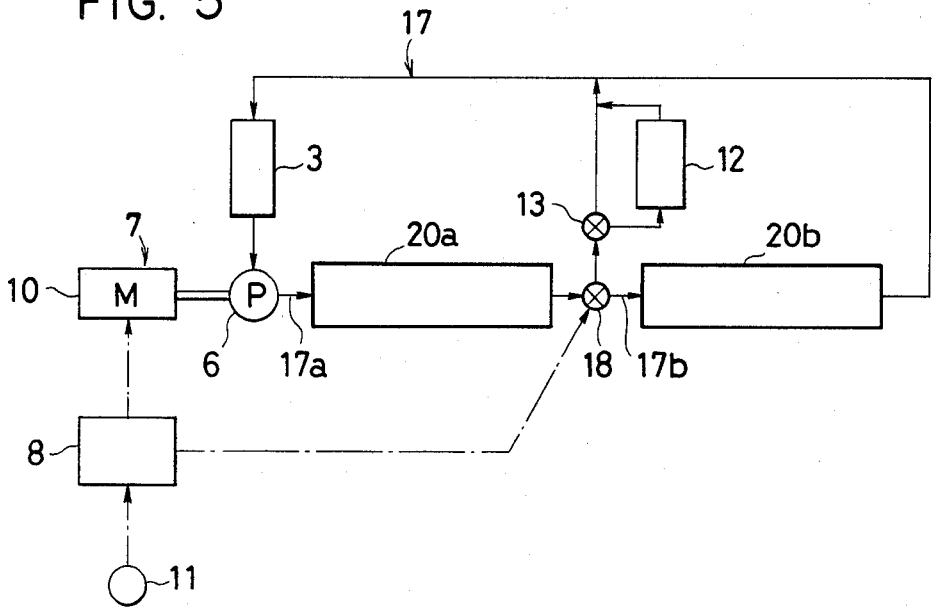
FIG. 5 is a diagrammatical view similar to FIG. 4 but showing another embodiment.

FIG. 5 shows another embodiment of the present invention in which the water jacket 20*a* in the cylinder head is connected on one hand with the water pump 6 provided in a cooling water passage 17 through a water passage 17*a* and on the other hand in series with the water jacket 20*b* in the cylinder block through a water passage 17*b*. In the water passage 17*b*, there is provided a bypass valve 18 for passing the cooling water from the jacket 20*a* directly to the passage 17 wholely or partly bypassing the jacket 20*b*. The controller 8 functions to control both the motor 10 and the valve 18 so as to obtain the cooling water flow as shown in FIG. 2(A) or (B).

Referring further to FIG. 7, there is shown another example of the control circuit which can be used with the arrangement shown in FIG. 1. The circuit is similar to that shown in FIG. 3(B) except that it has no feedback resistors associated with the comparators $COM_1$ and $COM_2$. With this circuit, both the motors 10*a* and 10*b* are stopped under the engine temperature lower than the value $T_1$ as shown in FIG. 6(A). With the engine temperature between the values $T_1$ and $T_2$, a high level output is produced at the comparator $COM_1$ so that the motor 10*a* is operated. Thus, the cooling water circulation is provided through the jacket 20*a* as shown by a line a in FIG. 6(A). As the engine temperature increases beyond the value $T_2$, the motor 10*b* is also operated so that the cooling water is circulated through the jackets 20*a* and 20*b* as shown by a line b in FIG. 2(A). It is also possible to change the flow of cooling water steplessly as shown in FIG. 6(B) by properly designing the comparators $COM_1$ and $COM_2$ in the circuit shown in FIG. 3(B).

The invention has thus been shown and described with reference to specific embodiments, however, it should be noted that the invention is in no way limited to the details of the illustrated arrangements but changes and modifications may be made without departing from the scope of the appended claims.

We claim:

1. A cooling system for a liquid-cooled internal combustion engine including a high temperature portion and a low temperature portion, said cooling system comprising first cooling liquid passage means having first cooling liquid jacket means provided in the high temperature portion of the engine for passing cooling liquid therethrough, second cooling liquid passage means have second cooling liquid jacket means provided in the low temperature portion of the engine for passing cooling liquid therethrough, cooling liquid pump means for circulating the cooling liquid through said first and second passage means and said first and second jacket means, driving means for driving said pump means at a speed independent of engine speed, engine temperature sensing means for sensing engine temperature and producing an engine temperature signal, control means adapted to receive the engine temperature signal and control said driving means to decrease the speed of said pump means when the engine temperature is below a first predetermined value so that the overall amount of cooling liquid circulation is decreased and the cooling liquid is passed only through said high temperature portion of the engine.

2. A cooling system in accordance with claim 1 in which said control means includes means for stopping said driving means under a temperature below a second predetermined value which is lower than said first predetermined value.

3. A cooling system for a liquid-cooled internal combustion engine including a high temperature portion and a low temperature portion, said cooling system comprising first cooling liquid passage means having first cooling liquid jacket means provided in the high temperature portion of the engine for passing cooling liquid therethrough, second cooling liquid passage means having second cooling liquid jacket means provided in the low temperature portion of the engine for passing cooling liquid therethrough, cooling liquid pump means for circulating the cooling liquid through said first and second passage means and said first and second jacket means, driving means for driving said pump means, engine temperature sensing means for sensing engine temperature and producing an engine temperature signal, control means adapted to receive the engine temperature signal and control said driving means so that the overall amount of cooling liquid circulation is decreased and the cooling liquid is passed only through said high temperature portion of the engine, when the engine temperature is below a first predetermined value, said cooling liquid pump means including first pump means for feeding the cooling liquid to said first cooling liquid passage means and second pump means for feeding the cooling liquid to said second cooling liquid passage means.

4. A cooling system for a liquid-cooled internal combustion engine including a high temperature portion and a low temperature portion, said cooling system comprising first cooling liquid passage means having first cooling liquid jacket means provided in the high temperature portion of the engine for passing cooling liquid therethrough, second cooling liquid passage means having second cooling liquid jacket means provided in the low temperature portion of the engine for passing cooling liquid therethrough, cooling liquid pump means for circulating the cooling liquid through said first and second passage means and first and second jacket means, driving means for driving said pump means, engine temperature sensing means for sensing engine temperature and producing an engine temperature signal, control means adapted to receive the engine temperature signal and control said driving means so that the overall amount of cooling liquid circulation is decreased and the cooling liquid is passed only through said high temperature portion of the engine, when the engine temperature is below a first predetermined value, said first and second cooling liquid passage means connected in series with bypass valve means provided between said first and second cooling water passage means, said control means including means for controlling said bypass valve means so that said second cooling water passage means is bypassed at an engine temperature below said first predetermined value.

5. A cooling system in accordance with claim 1 in which said first and second cooling water passage means are connected in parallel with each other with flow divider valve means disposed therebetween, said control means including means for controlling said bypass valve means so that said second cooling water passage means is bypassed at an engine temperature below said first predetermined value.

6. A cooling system in accordance with claim 1 in which said driving means includes electric motor means.

7. A cooling system in accordance with claim 1 in which said high temperature portion is a cylinder head and said low temperature portion is a cylinder block.

8. A cooling system in accordance with claim 1 in which said control means includes means for changing speed of said pump means steplessly in accordance with the engine temperature.

* * * * *